US007909279B2

(12) United States Patent
Condon et al.

(10) Patent No.: US 7,909,279 B2
(45) Date of Patent: Mar. 22, 2011

(54) IMPACT CRUSHER WEAR COMPONENTS INCLUDING WEAR RESISTANT INSERTS BONDED THEREIN

(75) Inventors: Gary John Condon, Irwin, PA (US); Don C. Rowlett, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 513 days.

(21) Appl. No.: 11/609,506

(22) Filed: Dec. 12, 2006

(65) Prior Publication Data

US 2008/0135659 A1 Jun. 12, 2008

(51) Int. Cl.
*B02C 19/00* (2006.01)

(52) U.S. Cl. ..... 241/275; 241/300

(58) Field of Classification Search ..... 241/182, 241/183, 299, DIG. 30, 275, 300
See application file for complete search history.

(56) References Cited

U.S. PATENT DOCUMENTS

| | | | | |
|---|---|---|---|---|
| 2,341,105 | A * | 2/1944 | Kueneman et al. | 241/266 |
| 2,843,331 | A * | 7/1958 | Reeves | 241/198.1 |
| 3,258,817 | A | 7/1966 | Smiley | |
| 3,607,606 | A * | 9/1971 | Beninga | 428/67 |
| 3,684,497 | A | 8/1972 | Wendler et al. | |
| 4,017,480 | A | 4/1977 | Baum | |
| 4,521,222 | A | 6/1985 | St. Pierre et al. | |
| 5,055,336 | A * | 10/1991 | Davis | 428/137 |
| 5,096,193 | A | 3/1992 | Lee | |
| 5,814,759 | A | 9/1998 | Mravic et al. | |
| 5,880,382 | A | 3/1999 | Fang et al. | |
| 5,954,282 | A | 9/1999 | Britzke | |
| 7,028,936 | B2 | 4/2006 | Condon | |
| 2003/0025020 | A1 | 2/2003 | Britzke | |
| 2003/0213861 | A1 | 11/2003 | Condon et al. | |
| 2007/0007376 | A1 * | 1/2007 | Condon et al. | 241/275 |

* cited by examiner

*Primary Examiner* — Faye Francis
(74) *Attorney, Agent, or Firm* — Matthew W. Gordon

(57) ABSTRACT

A wear component for use in an impact crusher having a forward depression on the face of the wear component which is exposed to aggregate wear. Wear resistant inserts, for example cemented tungsten carbide inserts, are bonded within the forward depression to prevent rapid abrasion of the wear component. Joints are formed between wear resistant inserts and joints are also formed between wear resistant inserts and the wear component. Bonding material fills the joints to further secure the wear resistant inserts and to prevent crack propagation.

12 Claims, 3 Drawing Sheets

IMPACT CRUSHER WEAR COMPONENTS INCLUDING WEAR RESISTANT INSERTS BONDED THEREIN

FIELD OF THE INVENTION

The present invention relates to impact crusher wear components, and more particularly relates to the use of wear resistant inserts bonded in wear components such as anvils, impellers, and table plates.

BACKGROUND INFORMATION

A major segment of the aggregate industry employs Vertical Shaft Impact (VSI) crushers to reduce large earth materials to smaller sized aggregate. VSI crushers rely on centrifugal force to disperse large aggregate through the crusher, and to impact the aggregate against a wide variety of impact crusher components to break up, reduce in size, and ultimately eject from the crusher, aggregate composed of desired shapes, sizes and consistency. Movement of abrasive materials such as aggregates through equipment causes abrasion and fatigue which wears out many components of the equipment. Efforts have been devoted to improvements in the design and construction of components of impact crushers to reduce the cost of acquiring and operating crushers, to enhance wear resistance of the component parts of crushers, and to facilitate rapid replacement of worn parts of crushers to enable the user of crushers to lose the least possible amount of time during which a crusher is inoperative due to worn parts.

The main components used to crush aggregate in a VSI crusher are impellers and anvils. An impeller of an impact crusher rotates to receive and hurl aggregate against one or more crusher components generally known in the art as anvils. This reduces the size of the aggregate and causes significant wear on impellers and faces of anvils.

Many in the industry have attempted to combat wear of impellers and anvils by protecting these components with hardened material. The cost of most hard materials, such as tungsten carbide, makes it cost prohibitive to make an entire anvil or impeller from this material. For this reason, only surfaces exposed to the abrasion contain hard material while the remainder of the piece is made of less expensive material such as steel or cast iron. U.S. Pat. No. 7,028,936, having the same inventor and assignee as the current application, suggests casting carbide bars into an air-hardened steel alloy base. U.S. Pat. No. 5,954,282 to Briske suggests threading separate wear bars into a base. U.S. patent application Ser. No. 9/921,430 teaches press fitting separate wear bars into a base.

However, in these designs, gaps remain between the wear resistant surfaces so that the milder base surface is still exposed to abrasion. This can result in what is commonly termed "wash out". Wash out occurs when so much of the base surface has been eroded that it can no longer support the wear resistant piece. This causes the wear resistance piece to be dislodged from the base leaving the softer base material exposed to quick abrasion.

The present invention has been developed in view of the foregoing.

SUMMARY OF THE INVENTION

The present invention provides an anvil for use in a crusher. In one embodiment, an anvil has a forward face, which is the primary wear surface on the anvil. The forward face has a forward depression formed therein. Hardened material inserts are fixed within the forward depression using a bonding material that fills joint between the inserts and the forward depression. For example, the hardened inserts may be cemented tungsten carbide and the bonding material may be an epoxy adhesive. The cemented tungsten carbide inserts form an array within the forward depression. Narrow joints, less that 0.007 inch, are formed between the inserts and the depression sides and between inserts.

An aspect of the present invention is to provide an anvil for use in an impact crusher comprising an anvil body having a forward depression, an array of wear resistant inserts within the forward depression of the base; and a bonding material attaching the wear resistant inserts to the forward depression of the base.

Another aspect of the present invention is to provide a method of making an anvil for an impact crusher comprising the steps of providing an anvil body having a forward depression and bonding an array of wear resistant inserts in the forward depression of the anvil.

DETAILED DESCRIPTION

Figure 1:
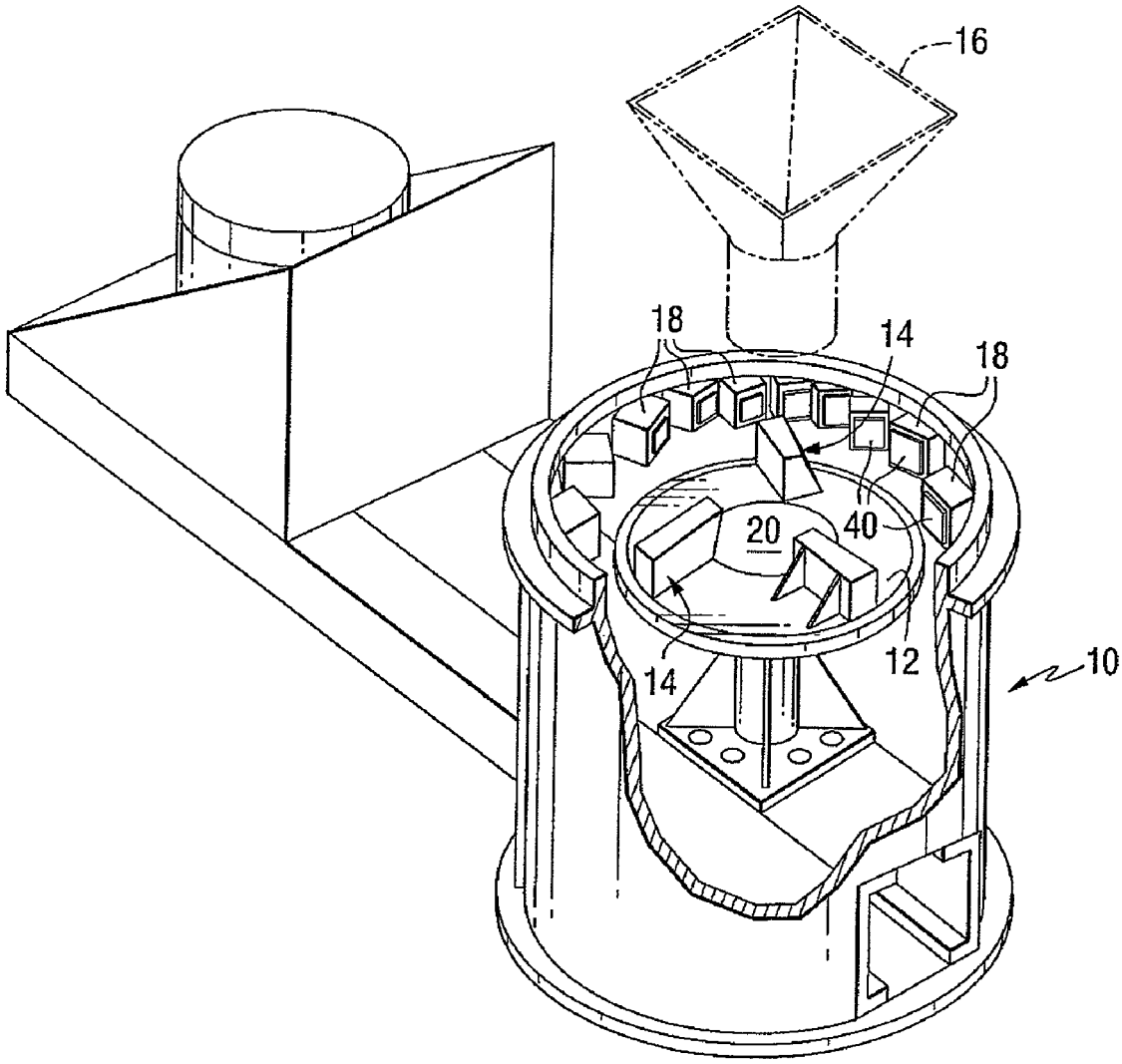
FIG. 1 is a perspective view of a common vertical shaft impact crusher with a cut away portion of the housing.

Referring now to FIG. 1, a vertical shaft impeller rock-crushing machine 10 includes an impeller turntable 12, which revolves at a high speed about a central shaft (not shown). Impeller blade shoes 14 are affixed to the turntable 12 at regular intervals along its surface. Rock or other aggregate (not shown) drops onto the turntable from a funnel 16 located above the turntable, and the centrifugal force caused by the rotating shoes 14 slings the rock outwards causing it to strike a series of anvils 18 and be crushed. Initially, the rock or aggregate falls on a central feed body 20 of the turntable 12, but as the turntable 12 rotates, the rock spreads outward along the central feed body 20 forming streams of material, particulate in nature, which flow across the wear surfaces of each of the impeller blade shoes 14 and out into the anvils 18. Anvils 18 are aligned at specifically designed angles relative to the radius of the turntable 12. The orientation, geometry and angle of the impact surface influences the size and distribution of the aggregate produced. The anvils 18 are mounted within the crusher by methods well known in the industry. In accordance with the present invention, some or all of the anvils 18 may be provided with an array of wear resistant inserts 40 bonded within a depression on the wear surface of each anvil 18, as more fully described below. A vertical shaft impact crusher and the components thereof are well described in U.S. Pat. No. 7,028,936, which is hereby incorporated by reference in its entirety.

Figure 2:
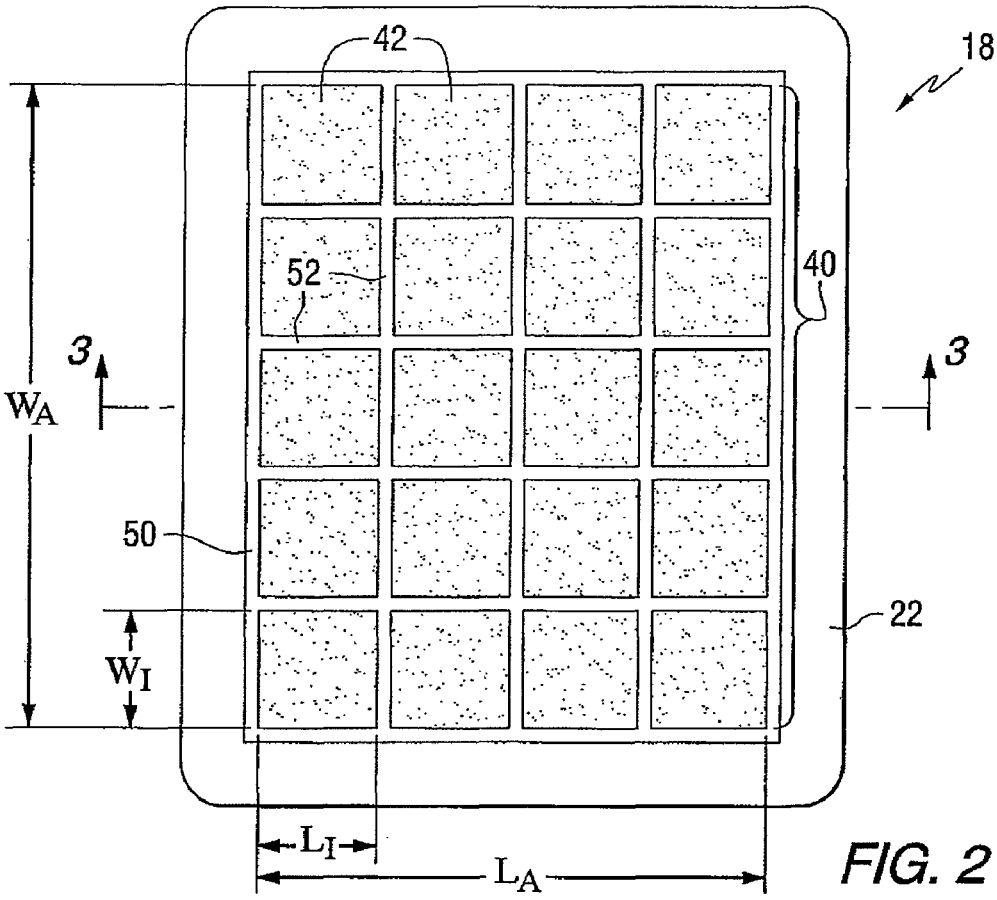
FIG. 2 is a front view of an anvil with wear resistant material inserts in accordance with an embodiment of the present invention.
Figure 3:
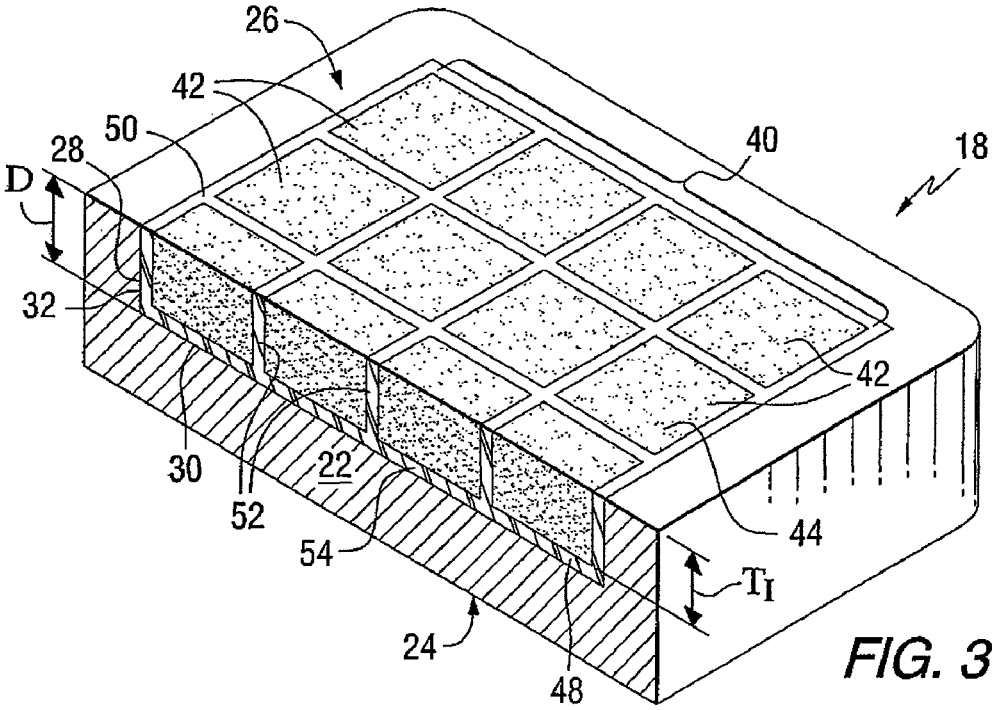
FIG. 3 is an oblique, cross sectional view of the anvil shown in FIG. 2 along line 3-3.

FIGS. 2 and 3 illustrate an anvil 18 in accordance with an embodiment of the present invention. It should be appreciated that the employed materials, general construction and method of making the anvil 18 and are applicable to other components on any equipment exposed to material flow in any industry, including construction and mining. It is contemplated for instance that impellers and table plates on the impeller crusher could also be made in accordance with the following description.

The anvil 18 has a forward face 26, which is exposed to the aggregate streams within the crusher 10, and rear face 24 that mounts to the crusher 10. A forward depression 28 is formed in the forward face 26 of the anvil 18. The forward depression 28 includes a bottom surface 30 and side surfaces 32. The forward depression 28 has a depth D as shown in FIG. 3 which may typically range from 0.25 inch to 0.75 inch, for example about 0.5 inch. An array 40 of wear resistant inserts 42 is bonded within the forward depression 28. A bonding material 54 may be used to securely hold the wear resistant inserts 42 in place.

The anvil body 22 may be constructed of materials such as air hardened, high carbon steel or any other alloy familiar to the industry. However, the array of wear resistant inserts 40 within the forward depression lessens the need to use more expensive wear resistant, alloy or high carbon steels in the anvil body 22. The wear resistant inserts 42 allow for the use of less expensive metal alloys for the anvil body 22 since the anvil body 22 is protected by the wear resistant inserts 42 and not subject to high abrasion. It is also contemplated that the anvil body 22 may be constructed from a white cast iron, a low alloy steel or from a composite of steels where portions of the anvil body 22 around the forward depression 28 are harder steel than those portions closer to the rear face 24 of anvil 18.

The wear resistant inserts 42 may be made from any suitable material such as cemented tungsten carbide. For example, cemented tungsten carbide for use in this application may have 6% cobalt, with properties of 88 to 93 HRA. The cobalt may fall within the range of 5.5-16.0 wt. %. For applications requiring increased wear resistance the cobalt may comprise 5.5-9.0 wt. % of the material; for other applications requiring better toughness it might fall within the range of 11.0-14.0 wt. %. While cemented tungsten carbide may be used for this application, other super hard wear resistant materials such as ceramics and or cermets may be used. For example, chromium carbide coated metals and other cermets where titanium carbide or vanadium carbide are added to tungsten carbide may be used. Ceramics appropriate for this application may include aluminum-based, silicon-based, zirconium-based and glass ceramics.

The wear resistant inserts 42 shown in FIGS. 2 and 3 are arranged in an array of wear resistant inserts 40 within the forward depression 28. Each wear resistant insert 42 has a wear face 44 exposed to the aggregate streams and a bonded face (not shown) in contact with the bonding material 54, facing the forward depression. The wear face 44 and bonded face 46 of a wear resistant insert 42 may be generally flat. A backing joint 48 is formed between the bonded faces 46 and the bottom surface 30 of the forward depression 28 in the anvil 18. The backing joint 48 is filled with bonding material 54. The backing joint 48 typically has a thickness of from 0.005 inch to 2.000 inches, for example, about 1.000 inch. The wear resistant inserts 42 have sides that abut the sides of adjacent wear resistant inserts 42 to form insert joints 52. Insert joints 52 typically have a width of from 0.005 inch to 0.500 inches, for example, about 0.006+/−0.001 inch. A peripheral joint 50 is formed between wear resistant inserts 42 and sides 32 of the forward depression 28. The peripheral joint 50 typically has a width of from 0.005 inch to 0.500 inch, for example, from 0.005 inch to 0.015 inch.

FIG. 2 shows an example of an arrangement of twenty rectangular wear resistant inserts 42 placed in a series of rows and columns. Such arrangements are beneficial because they provide an easily manufactured standard shape for the wear resistant inserts 42 that minimizes the length of joints created between inserts. Insert geometries may be varied provided good fit and designed joints can be maintained between adjacent inserts and between wear resistant inserts 42 and the forward depression 28. For example, the wear resistant inserts 42 may be triangular and have only three sides or hexagonal with six sides. In another embodiment, the wear resistant inserts may have an interlocking geometry, such as a tongue and groove design or a shiplap joint.

The wear resistant inserts 42 can be of varied sizes. In one embodiment each insert is 1"×1"×⅝" deep. Length and width, shown as $L_I$ and $W_I$ respectively in FIG. 2, can typically range from 0.5 to 6 inches, for example 1 inch. The thickness, shown as $T_I$ in FIG. 3, can typically range from 0.25 to 3 inches. The number of wear resistant inserts 42 required depends on the size of the anvil 18 and the size of the wear resistant inserts 42 used. $L_A$ in FIG. 2 refers to the overall length of the array of wear resistant inserts 40. $L_A$ is typically 3 inches to 10 inches. $W_A$ in FIG. 2 refers to the overall width of the array of wear resistant inserts 40. $W_A$ is typically 3 inches to 10 inches. It is common in the crusher industry to quantify anvils 18 by mass. The invention applies to all sizes of anvils, but has specific application to 15 pounds to 75 pounds range of anvils.

In one embodiment, the bonding material 54 is a thermoset epoxy adhesive capable of bonding to metals. The epoxy forms a strong permanent bond between the forward depression in anvil 28 and the wear resistant inserts 42. The bonding material 50 is present within the insert joints 52 and the peripheral joint 50. This provides bonding between the wear resistant inserts 42. The epoxy may be introduced into the insert joints 52 and peripheral joint 50 by applying a change of pressure and increased temperature to the bonding material 50 and wear resistant inserts 42 prior to setting or curing of the bonding material. Control of atmospheric pressure and type of gas is dependent on the type of bonding agent and process used. Other materials capable of bonding metals may be used as the bonding material. Other suitable bonding materials capable of chemical adhesion may include brazing alloys and airset epoxies. Suitable methods of attachment may also include mechanical or welded type attachments such as bolting or plug welding.

The insert joints 52 between wear resistant inserts 42 serve to prevent crack propagation. It is common for hard materials such as cemented tungsten carbide to crack. A single crack in a one-piece insert design could cause the entire anvil to quickly fail. Whereas, a crack in an insert that is a small part of a larger array will affect only the cracked insert which is less likely to impact on the life of the anvil. This is the reason using many smaller wear resistant inserts 42 with insert joints 52 between is preferable to using one large wear resistant insert 42 to fill the forward depression 28.

The use of multiple wear resistant inserts 42 also allows anvils to be tailored to be application specific. In one embodiment, inserts are appropriately selected based on the material hardness and toughness required for the particular application. For example, the center sections of an anvil 18 within a VSI crusher will usually experience higher wear than the upper and lower sections. Therefore, tungsten carbide inserts with Co in the range of 5.5-9.0 wt. % could be used in a center portion of the forward depression 28 of the anvil 18 while a less expensive insert may be used in the upper and lower portions of the forward depression 28 of the anvil 18. This flexibility in design will increase the performance of the anvils 18 while saving costs associated with the manufacture of anvils 18.

Figure 4:
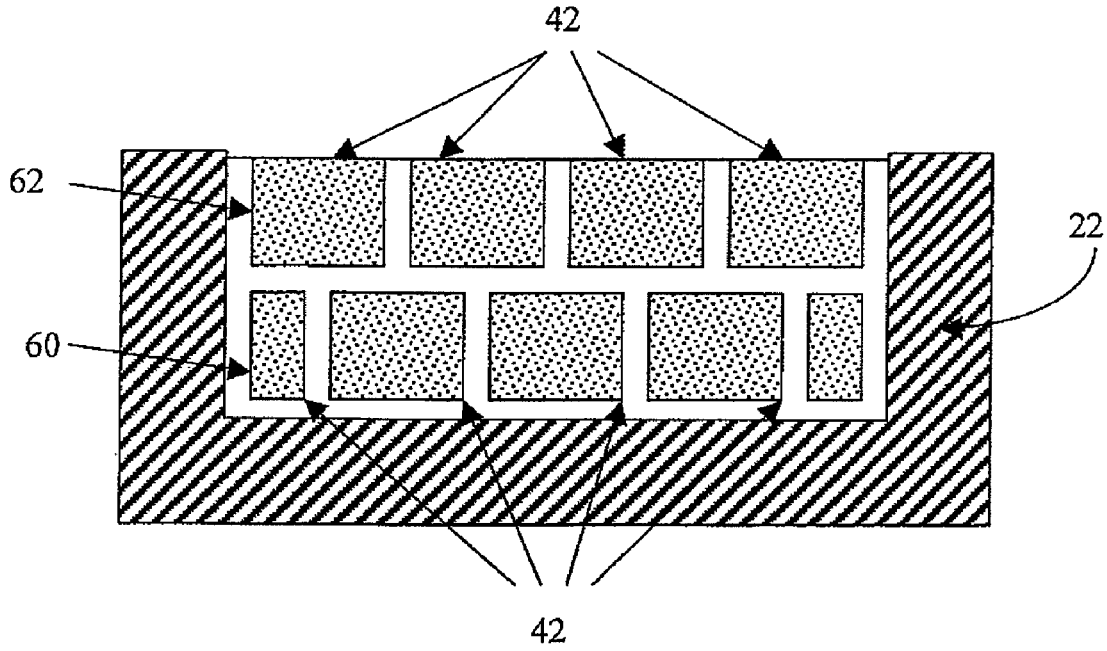
FIG. 4 is a cross section of an anvil with two layers of wear resistant inserts in accordance with another embodiment of the present invention.

In an embodiment shown in FIG. 4, the wear resistant inserts are arranged in two layers. An interior layer 60 operates as a safety barrier should the outer layer 62 wear through or become dislodged. The layers 60, 62 are installed in a staggered pattern to counter erosion of joints.

Figure 5:
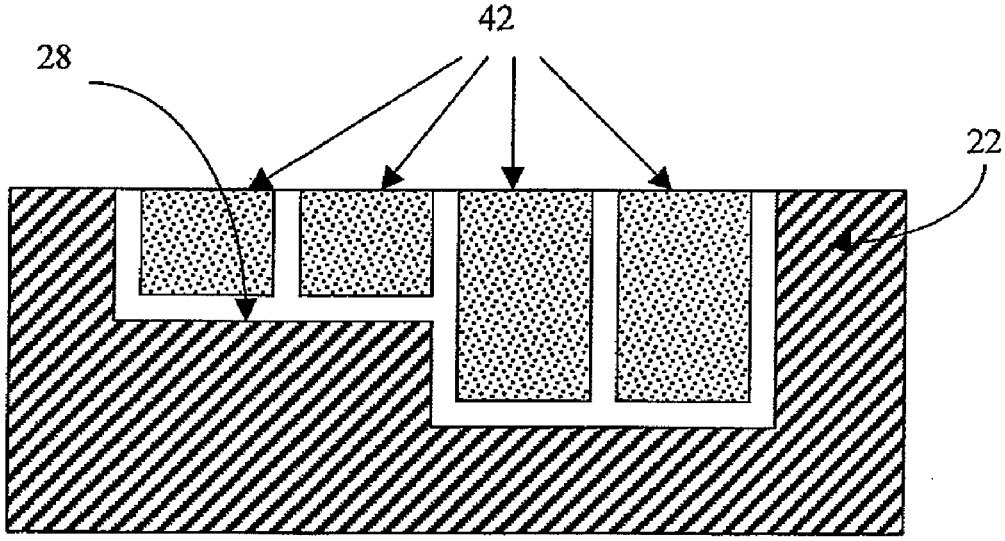
FIG. 5 is a cross section of an anvil with inserts of different thicknesses in accordance with another embodiment of the present invention.

In another embodiment shown in FIG. 5, the wear resistant inserts 42 are thicker in high wear areas. In this embodiment, the recess 28 is congruently shaped to accommodate thicker wear resistant inserts 42 in the high wear areas. It should be appreciated that the thicker inserts may be configured in ways other than that shown in FIG. 5. For example, the thicker inserts may be in the center of the anvil or more or less rows of inserts may be needed.

As mentioned above, the anvil angles relative to a radius of the turntable 12 determine the size and distribution of the aggregate produced. Conventional anvils and those subject to "wash out" tend to wear quickly and unevenly. Uneven wear of the forward surface of an anvil 18 causes the anvil angle to change causing undesired aggregate size and distribution. The anvils of the present invention take longer to show any signs of wear. Accordingly, the anvils of the present invention produce a more consistent and predictable reduction in aggregate size and particle distribution.

Whereas particular embodiments of this invention have been described above for purposes of illustration, it will be evident to those skilled in the art that numerous variations of the details of the present invention may be made without departing from the invention.

We claim:

1. A wear component for use in an impact crusher that receives and crushes an aggregate comprising:

a body having a forward depression, the forward depression having a bottom interior surface and a plurality of depression sides extending from the bottom interior surface;

an array of wear resistant inserts within the forward depression of the body, each wear resistant insert having a wear face exposed to the aggregate to crush the aggregate; and a bonding material attaching the wear resistant inserts to the forward depression of the body, wherein the wear resistant inserts comprise a cermet containing tungsten carbide.

2. A wear component according to claim 1 wherein adjacent wear resistant inserts intersect to form insert joints.

3. A wear component according to claim 2 and wherein a peripheral joint is formed between the array of wear resistant inserts and the depression sides.

4. A wear component according to claim 3 wherein the bonding material is infused into the insert joints and the peripheral joint.

5. A wear component according to claim 1 wherein the wear resistant inserts are rectangular and wherein the wear resistant inserts are aligned in rows and columns.

6. A wear component according to claim 1 wherein the bonding material is an epoxy adhesive.

7. A wear component according to claim 1 wherein the wear resistant inserts further comprise at least one other compound selected from the group consisting of titanium carbide, zirconium carbide and vanadium carbide.

8. A wear component according to claim 1 wherein the wear resistant inserts comprise an aluminum-based ceramic, silicon-based ceramic, zirconium-based ceramic or glass ceramic.

9. A wear component according to claim 1 wherein the body comprises carbon steel.

10. A wear component according to claim 1 wherein the body comprises a low alloy steel.

11. A wear component according to claim 1 wherein the body comprises a steel composite.

12. A wear component according to claim 1 wherein the body comprises a high chrome iron.

* * * * *